United States Patent [19]

Swanson et al.

[11] Patent Number: 4,855,702

[45] Date of Patent: Aug. 8, 1989

[54] LINEAR ELECTROMAGNETIC ACTUATOR

[75] Inventors: Thomas K. Swanson; Elwood J. Meyers, both of Rockford, Ill.

[73] Assignee: Barber-Colman Company, Loves Park, Ill.

[21] Appl. No.: 250,752

[22] Filed: Sep. 28, 1988

[51] Int. Cl.[4] ..... H01F 7/08

[52] U.S. Cl. ..... 335/261; 335/262

[58] Field of Search ..... 335/251, 255, 261, 262, 335/279

[56] References Cited

U.S. PATENT DOCUMENTS 3,303,445 2/1967 Flentge ..... 335/261 X 4,044,324 8/1977 Coors ..... 335/262 X 4,267,897 5/1981 Takeshima ..... 335/262 X

*Primary Examiner*—George Harris

*Attorney, Agent, or Firm*—Rockey and Rifkin

[57] ABSTRACT

An electromagnetic actuator includes a frusto-conical projection having a central opening formed therein. A winding is contained in a housing surrounding the projection which encompasses the projection. A shaft extends through a central opening in the projection and carries an armature having a reciprocally configured frusto-conical surface. Excitation of the winding causes linear movement of the shaft on bearings contained within the housing.

4 Claims, 1 Drawing Sheet

LINEAR ELECTROMAGNETIC ACTUATOR

BACKGROUND OF THE INVENTION

This invention relates generally to electromagnets. More specifically, it relates to an electromagnetic positioning device capable of provide an output force essentially linear with respect to the applied current.

Electromagnetic acutators or positioners are of course well known in the art and are in common use. One such device is shown in the patent to Barrett et al. No. U.S. Pat. No. 3,883,839, wherein the actuator or armature moves on a shaft and is hollowed to accommodate bearings and a return spring. In the U.S. patent to Eckert No. 3,735,302 an armature moves on a guide loft against the force of a spring. Other U.S. patents showing electromagnetic actuators generally of the type herein disclosed and claimed are U.S. Pat. Nos. 3,161,791; 2,407,603; 3,381,250; 1,226,697; 3,225,747; and 2,802,428.

It is an object to provide a novel electromagnetic actuator which is relatively economical to construct while at the same time providing an output essentially linear with respect to the input current.

This and other objects are achieved by the provision of an armature secured to an output shaft so that both are movable linearly. Spaced bearings mounted along the shaft help to ensure linear movement of the output shaft.

DETAILED DESCRIPTION OF THE PREFERRED EMBODIMENT

Figure 1:
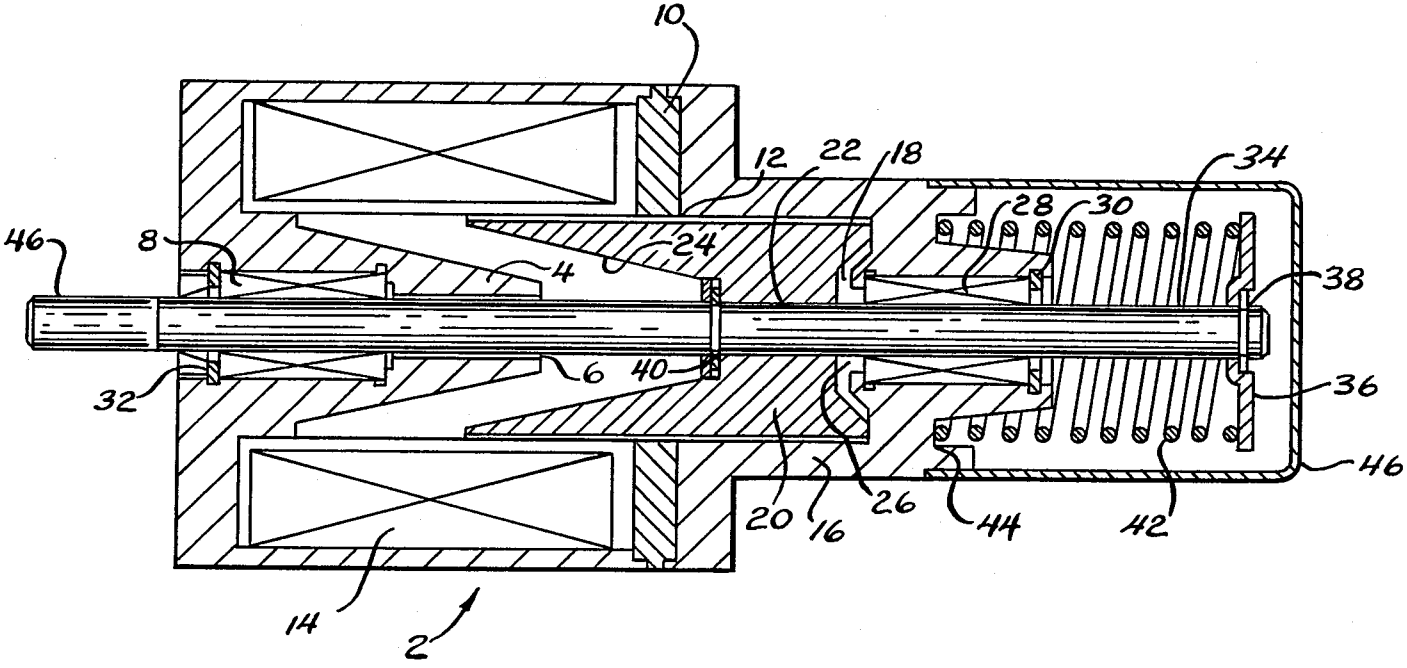
FIG. 1 is a sectional illustration of the described embodiment.

In the embodiment illustrated, a cup-shaped housing 2 is formed of a magnetizable material, for instance a 1018 or 1215 steel. Formed in the bottom of the housing is a multi-angled frusto-conical projection 4 having a passage 6 therethrough. The passage 6 is enlarged at one end to accommodate a ball bearing 8. The top of the housing 2 is closed by a cover 10 having a central opening 12. The cover 10 is formed of the same magnetizable material as is the rest of the housing 2.

Mounted in the housing 2 is a winding or coil 14 which when excited creates a magnetic flux in the housing 2 and its cover 10.

An upper housing 16 is secured to the cover 10 by any suitable means such as by bolts (not shown). An enlarged central opening 18 in the upper housing accommodates an armature 20 formed with a central bore 22 with an enlarged single-angled frusto-conical portion 24 conforming to the 12° 30′ portion of the projection 4 of the housing. The armature 20 is formed from a magnetizable material and in response to excitation of the winding 14 will move toward the projection 4.

The upper housing 16 is completed by a narrower continuation 26 of the central opening 18. Retained in the central opening 26 is a second ball bearing 28 held in position by snap ring 30. The ball bearing is held in position by a seal 32.

The structure is completed by an output shaft 34 having a plate 36 at one end. A snap ring 38 holds the plate on the shaft while a snap ring 40 secures the shaft to the armature 20. A bias spring 42 extends between a surface 44 of the upper housing and the plate 36 to normally urge the shaft 34 and armature 20 away from projection 4. A cap 46 covers the end of the shaft and the spring.

As may be seen, the shaft 34 extends through the ball bearing 28, the central opening 22 of the armature, and is secured thereto by the snap ring 40. It also extends through central opening 6 of the projection 4, the ball bearing 32, and has a portion 46 extending outwardly of the housing 2. The portion 46 may be connected by any suitable means to any element it may be desired to actuate, as for instance, the control element of a governor.

The construction disclosed is one which is economical to manufacture and yet at the same time is accurate and provides a stable straight line output. These results are achieved in part by the provision of the ball bearings mounted at positions spaced along the shaft. Also, the construction is such that easy assembly of the parts is possible.

Obviously, various modifications may be made in the design of a device in accordance with the invention, and it is intended by the claims appended hereto and forming a part of the specification to cover all such modifications as are within their scope.

What is claimed is:

1. An electromagnetic actuator comprising:

a cup-shaped housing of magnetizable nature having a frusto-conical projection extending inwardly; said projection having a central opening formed therein; a cover of magnetizable material on said housing and having a central opening formed therein; a winding mounted in said housing and encompassing said projection; a shaft extending through said central opening of said projection; an armature having a frusto-conical surface conforming to the frusto-conical projection and secured to a mid-portion of said shaft whereby when said winding is excited said armature will move toward said projection and said shaft will move linearly; an upper housing secured to said cover; bearings mounted in said projection and said upper housing; wherein said shaft is supported for movement on said bearings.

2. The electromagnetic actuator of claim 1 wherein said shaft has a portion extending from said armature through said upper housing; a plate secured to said shaft portion; and a spring extending between a surface of said upper housing and said plate to urge said shaft and said armature away from said projection.

3. The electromagnetic actuator of claim 2 including a cap covering said shaft portion, said plate, and said bearing spring.

4. The electromagnetic actuator of claim 3 wherein said shaft has an output portion extending outwardly of said housing.

* * * * *

US004855702B1

REEXAMINATION CERTIFICATE (2065th)

United States Patent [19]

Swanson et al.

[11] B1 4,855,702

[45] Certificate Issued Jul. 20, 1993

[54] LINEAR ELECTROMAGNETIC ACTUATOR

[75] Inventors: Thomas K. Swanson, 1331 5th Ave., Rockford, Ill. 61104; Elwood J. Meyers, 1570 Featherstone Rd., Rockford, Ill 61107

[73] Assignees: Thomas K. Swanson; Elwood J. Meyers

Reexamination Request:
No. 90/002,799, Jul. 27, 1992

Reexamination Certificate for:

| | |
|---|---|
| Patent No.: | **4,855,702** |
| Issued: | **Aug. 8, 1989** |
| Appl. No.: | **250,752** |
| Filed: | **Sep. 28, 1988** |

[51] Int. Cl.[5] ..... H01F 7/08

[52] U.S. Cl. ..... 335/261; 335/262; 335/279; 335/281

[56] References Cited

U.S. PATENT DOCUMENTS

| | | | |
|---|---|---|---|
| 3,303,445 | 2/1967 | Flentge | 335/255 |
| 3,735,302 | 5/1973 | Eckert | 335/262 |
| 3,883,839 | 5/1975 | Barrett et al. | 338/116 |
| 3,900,822 | 8/1975 | Hardwick et al. | 335/268 |
| 4,081,774 | 3/1978 | Barrett et al. | 335/228 |
| 4,267,897 | 5/1981 | Takeshima | 180/143 |

OTHER PUBLICATIONS

*Electromagnetic Devices*, first edition, by Herbert C. Roters, John Wiley & Sons, Inc. (1941).

SAE article, High-Pressure Injection Pumps with Electronic Control for Heavy-Duty Diesel Engines, by R. Schwartz of Robert Bosch GmbH (1985).

*Primary Examiner*—Leo P. Picard

[57] ABSTRACT

An electromagnetic actuator includes a frusto-conical projecting having a central opening formed therein. A winding is contained in a housing surrounding the projection which encompasses the projection. A shaft extends through a central opening in the projection and carries an armature having a reciprocally configured frusto-conical surface. Excitation of the winding causes linear movement of the shaft on bearings contained within the housing.

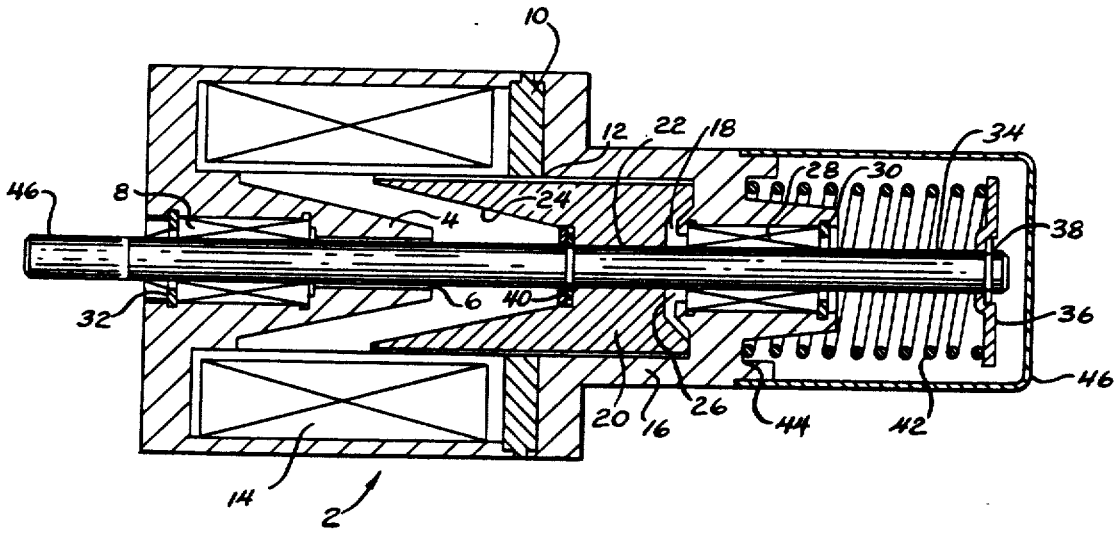

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 2–4 is confirmed.

Claim 1 is cancelled.

* * * * *